US007178801B2

(12) United States Patent
Kokubo et al.

(10) Patent No.: US 7,178,801 B2
(45) Date of Patent: Feb. 20, 2007

(54) ACCUMULATING AND DELIVERING APPARATUS FOR CARDBOARD SHEETS

(75) Inventors: Hidenori Kokubo, Kasugai (JP); Hiromi Watanabe, Kasugai (JP); Jiro Minami, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 15 days.

(21) Appl. No.: 10/928,593

(22) Filed: Aug. 27, 2004

(65) Prior Publication Data

US 2005/0063813 A1 Mar. 24, 2005

(30) Foreign Application Priority Data

Sep. 1, 2003 (JP) ..... 2003-308964
Aug. 24, 2004 (JP) ..... 2004-244000

(51) Int. Cl.
*B65H 31/30* (2006.01)

(52) U.S. Cl. ..... 271/213; 414/790.3; 414/789.9; 414/790.8

(58) Field of Classification Search ..... 271/214, 271/207, 213, 215; 414/790.3, 790.7, 790.8, 414/790.9, 416.04, 4, 792.2, 793.9, 794.1, 414/794.7, 794.8, 789.9, 790.4
See application file for complete search history.

(56) References Cited

U.S. PATENT DOCUMENTS 3,759,402 A * 9/1973 Hitch et al. ..... 414/790.3
3,883,131 A * 5/1975 Anderson et al. ..... 493/433
3,892,168 A 7/1975 Grobman
4,311,475 A 1/1982 Imai
5,018,717 A * 5/1991 Sadwick et al. ..... 271/207
5,160,129 A * 11/1992 Siriporn et al. ..... 271/178
5,493,104 A 2/1996 Wilson
5,545,001 A * 8/1996 Capdeboscq ..... 414/790.8
5,558,318 A * 9/1996 Crowley et al. ..... 270/39.05
6,099,452 A * 8/2000 Hoza et al. ..... 493/416

(Continued)

FOREIGN PATENT DOCUMENTS

DE 36 14 884 A1 11/1987

(Continued)

OTHER PUBLICATIONS

European Search Report in Appln. 04 020 772.2 (mailed Jan. 31, 2005).

*Primary Examiner*—Patrick Mackey
*Assistant Examiner*—Jeremy R. Severson
(74) *Attorney, Agent, or Firm*—Stroock & Stroock & Lavan, LLP

(57) ABSTRACT

An apparatus for accumulating and delivering folded cardboard sheets includes at least a pair of stacking bases moveable along a loop including a stacking position for stacking the cardboard sheets on the stacking bases and a delivering position for delivering the pile of cardboard sheets on the stacking bases. The apparatus receives cardboard sheets fed one by one, accumulates them in a pile consisting of a predetermined number of cardboard sheets, and delivers the pile of sheets. When one of the stacking bases moves away from the stacking position, the other is moved into the stacking position so that the stacking bases alternatively move into the stacking position. Preferably, the loop has resting and ejecting positions and when one of the stacking bases moves from the ejecting to the stacking position, that stacking base ejects the pile of sheets previously formed on the other stacking base.

4 Claims, 9 Drawing Sheets

U.S. PATENT DOCUMENTS

| | | | | |
|---|---|---|---|---|
| 6,142,075 | A * | 11/2000 | Koch et al. | 101/238 |
| 6,149,149 | A * | 11/2000 | Gammerler et al. | 271/218 |
| 6,497,549 | B2 | 12/2002 | Brown | |
| 2003/0189284 | A1* | 10/2003 | Ingelsten | 271/207 |
| 2003/0227129 | A1* | 12/2003 | Spoorenberg et al. | 271/207 |
| 2003/0234485 | A1* | 12/2003 | Gosslinghoff | 271/209 |
| 2005/0067763 | A1 | 3/2005 | Kokubo et al. | |

FOREIGN PATENT DOCUMENTS

| | | |
|---|---|---|
| FR | 2 683 215 | 5/1993 |
| JP | 2000-127262 A | 5/2000 |
| JP | 2000127262 A | 5/2000 |

* cited by examiner

ACCUMULATING AND DELIVERING APPARATUS FOR CARDBOARD SHEETS

TECHNICAL FIELD OF THE INVENTION

The present invention relates to an accumulating and delivering apparatus for cardboard sheets which receives the folded cardboard sheets being fed from a box making machine one by one, accumulates them in the form of a pile consisting of a predetermined number of the cardboard sheets, and delivers the pile of the cardboard sheets therefrom.

BACKGROUND ART OF THE INVENTION

In the manufacturing process of a cardboard box, firstly, a continuous web sheet of a cardboard is processed by a box making machine which makes an individual cardboard box folded in a sheet-like shape. Secondly, the processed cardboard sheets are transferred from the box making machine to an accumulating and delivering apparatus which receives the processed cardboard sheets one by one from the box making machine, accumulates them in the form of a pile consisting of a predetermined number of the cardboard sheets, and delivers the pile of the cardboard sheets therefrom. Japanese patent document 2000-127262(A1) discloses such an accumulating and delivering apparatus. This apparatus includes an elevator on which cardboard sheets are stacked, and the elevator is supported by a pivotably driven lever, whereby the elevator can be moved between its stacking position and its delivering position. When a pile of the cardboard sheets including a predetermined number thereof is stacked on the elevator, the pile is ejected by pushing it out using a cylinder device.

In the operation of the above mentioned apparatus, the cardboard sheets are stacked on the elevator in its stacking position, and when the number of the cardboard sheets reaches a predetermined number, the elevator is moved downwardly to its delivering position by the lever being driven. The elevator is moved upwardly again to its stacking position by the lever being driven after the pile of cardboard sheets on the elevator has been ejected by using the cylinder device. Since the cardboard sheets are successively fed from the box making machine even when the elevator is in its delivering position, a ledge is projected above the elevator in order to temporarily support the cardboard sheets.

However, after the pile of cardboard sheets on the elevator has been ejected when the elevator is located at its delivering position, then the elevator must be moved upwardly again to its stacking position. This does not allow many of the cardboard sheets to be temporarily supported on the ledge. Thus, the speed at which the cardboard sheets are fed is limited, which can cause lowering of production efficiency.

SUMMARY OF THE INVENTION

One object of the present invention is to provide an apparatus for accumulating and delivering cardboard sheets which can obtain a high production efficiency.

According to one aspect of the present invention, there is provided an accumulating and delivering apparatus for cardboard sheets being fed one by one comprising stacking bases for stacking said cardboard sheets thereon, and a stacking base driving means for moving said stacking bases in a vertical direction between a stacking position for stacking said cardboard sheets on said stacking bases in a form of a group and a delivering position for delivering said group of said cardboard sheets formed on said stacking base, wherein: said stacking bases comprise at least one pair of stacking bases; wherein said stacking base driving means moves said stacking bases in such a manner that when one of said stacking bases is moved away from said stacking position, another one of said stacking bases is moved into said stacking position.

Preferably, the accumulating and delivering apparatus for cardboard sheets in accordance with the present invention is characterized by the fact that each of said pair of stacking bases is moveable between said stacking position and said delivering position via a path including an ejecting position located rearwardly from said stacking position with respect to the feeding direction of said cardboard sheets, wherein when one of said stacking bases is moved from said ejecting position to said stacking position, said one of said stacking bases ejects said group of said cardboard sheets previously formed on another one of said stacking bases by pushing it out forwardly in a direction with respect to the feeding direction of said cardboard sheets.

Furthermore, the accumulating and delivering apparatus for cardboard sheets in accordance with the present invention is characterized by the fact that each of said pair of stacking bases is moveable via a path including said delivering position located below said stacking position and a resting position located rearwardly from said delivering position with respect to the feeding direction of said cardboard sheets, said stacking bases being moveable in accordance with the order of said stacking position, said delivering position, said resting position and said ejecting position, respectively, and said stacking bases being indexed at these respective positions, wherein one of said stacking bases and another one of said stacking bases are positioned in such a manner that they have positions alternating among said four positions.

Furthermore, the accumulating and delivering apparatus for cardboard sheets in accordance with the present invention is characterized by the fact that said stacking base driving means includes a stacking base vertical driving means for moving said one of the stacking bases downwardly from said stacking position to said delivering position while moving said other one of the stacking bases upwardly from said resting position to said ejecting position; and a stacking base horizontal driving means for moving said one of the stacking bases from said delivering position to said resting position rearwardly with respect to the feeding direction of said cardboard sheets while moving said other one of the stacking bases from said ejecting position to said stacking position forwardly with respect to the feeding direction of said cardboard sheets.

In addition, the accumulating and delivering apparatus for cardboard sheets in accordance with the present invention is characterized by the fact that it further comprises a stacking base controlling means for controlling the moving speed of said pair of stacking bases.

In accordance with the present invention, there is provided an apparatus for accumulating and delivering cardboard sheets to obtain a high production efficiency by moving a pair of stacking bases alternatively to the stacking position wherein when one of said stacking bases is moved away from said stacking position, and another one of said stacking bases is moved into said stacking position. In addition, if the movement of one of the stacking bases from its ejecting position to its stacking position is used in order to eject the stack of cardboard sheets previously formed on another one of the stacking bases, the production efficiency can be further improved.

BRIEF DESCRIPTION OF THE DRAWINGS

For a better understanding of the present invention, and to show more clearly how the same may be carried into effect, reference will now be made, by way of example, to the accompanying drawings, in which.

A PREFERRED EMBODIMENT OF THE INVENTION

Figure 1:
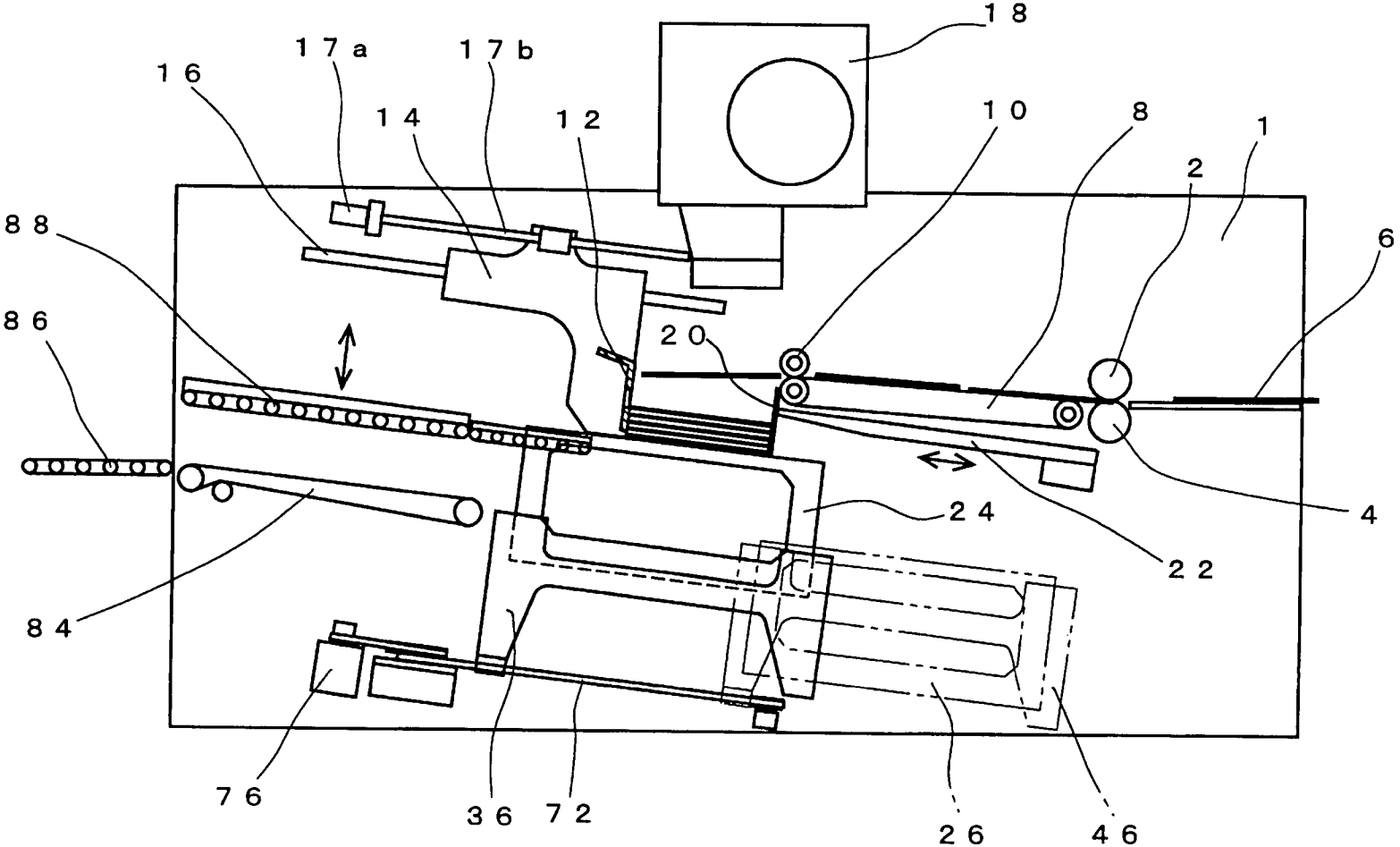
FIG. 1 illustrates a schematic side view of an accumulating and delivering apparatus for cardboard sheets in accordance with one embodiment of the present invention, wherein one of the stacking bases is in its stacking position.

As can be seen in FIG. 1, reference numeral 1 is a machine frame, which machine frame 1 includes a pair of inlet rollers 2 and 4, folded cardboard sheets 6 being fed from a box making machine (not shown) being fed one by one between the inlet rollers 2 and 4. A feeding conveyer 8 is disposed at a downstream side of the inlet rollers 2 and 4, and a feeding roller 10 is disposed at the front end of the feeding conveyer 8. A guiding plate 12 is disposed in a direction of feeding of the cardboard sheets 6 from the feeding conveyer 8 and feeding roller 10 in such a manner that the front end of the cardboard sheet 6 comes into contact with the guiding plate 12.

The guiding plate 12 is mounted on a sliding plate 14 moveably supported along a rail 16 which is mounted on the machine frame 1. The rail 16 is mounted to be parallel to the cardboard sheet 6 which is to be stacked on either one of stacking bases 24 and 26, as will be described in detail below. The sliding plate 14 can be moved along the rail 16 by rotating a threaded shaft 17*b* which is driven by a motor 17*a* mounted on the machine frame 1.

An air blower 18 is mounted at the top of the machine frame 1, and the air blown therefrom is directed toward the cardboard sheet 6 being fed by the feeding conveyer 8 and the feeding roller 10. An aligning plate 20 is disposed adjacent to the front end of the feeding conveyer 8 opposing to the guiding plate 12 in such a manner that the cardboard sheet 6 fed by the feeding conveyer 8 will drop in between the guiding plate 12 and the aligning plate 20. A ledge 22 is disposed below the feeding conveyer 8 which ledge 22 can be projected toward the guiding plate 12 through a window formed on the aligning plate 20. When the ledge 22 is projected, the cardboard sheets 6 are stacked thereon.

Figure 9:
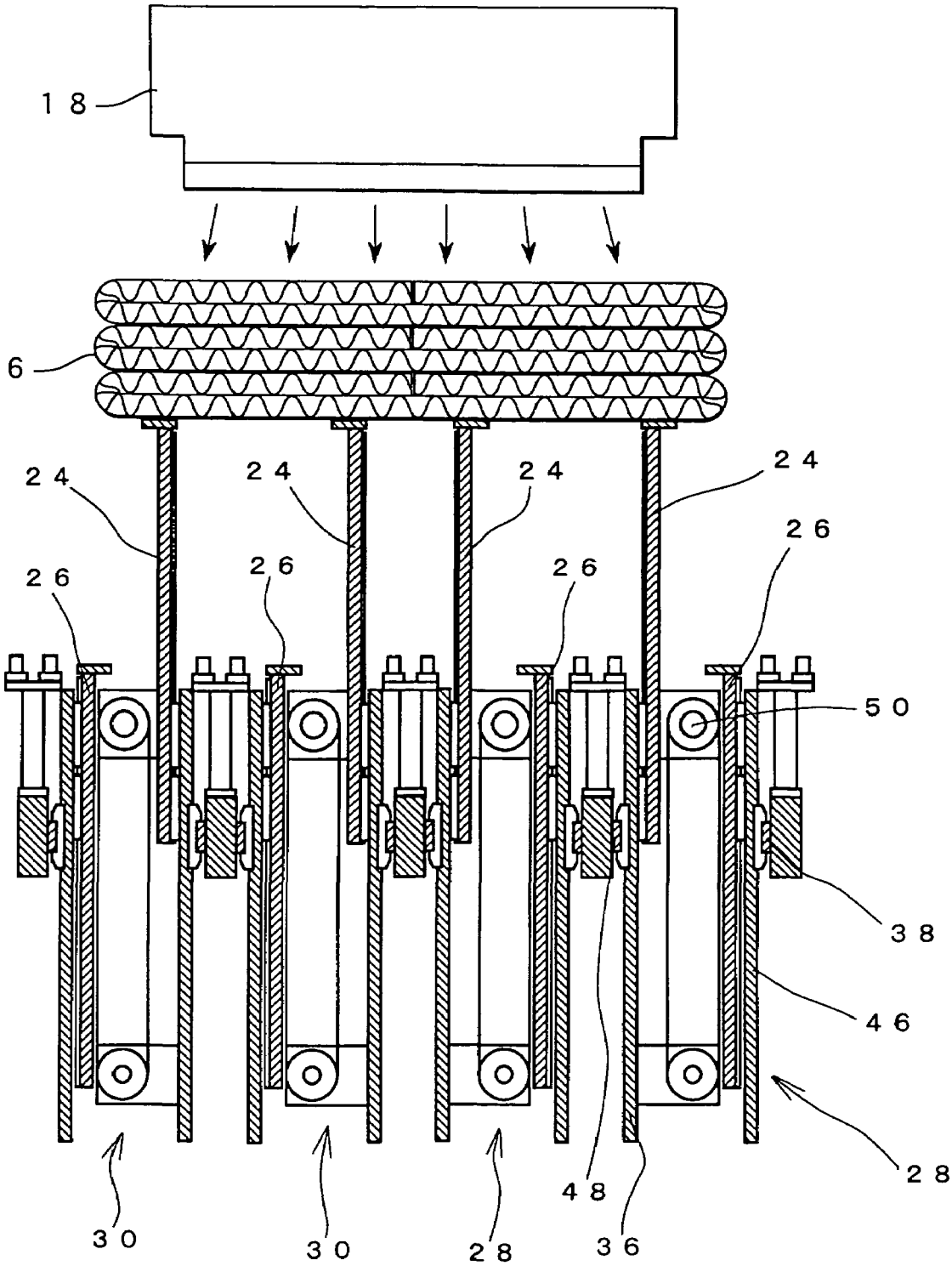
FIG. 9 illustrates a cross sectional front view of four pairs of driving mechanisms of an accumulating and delivering apparatus for cardboard sheets in accordance with one embodiment of the present invention.

In this embodiment, four sets of stacking bases 24,26, each set of which consisting of a pair of stacking bases 24,26, are aligned with each other in the widthwise direction of the cardboard sheet 6. As shown in FIG. 9, two sets of stacking bases 24,26 on the right side with respect to a vertical center line and two sets of stacking bases 24,26 on the left side with respect to a vertical center line are arranged symmetrically with respect to the vertical center line. The two sets of stacking bases 24,26 on the right side are mounted on corresponding driving mechanisms 28, respectively, while the two sets of stacking bases 24,26 on the left side are mounted on corresponding driving mechanisms 30, respectively.

In this embodiment, the four sets of stacking bases 24 and 26 are disposed below the guiding plate 12 and the aligning plate 20, and support the cardboard sheets 6 from below in order to stack a predetermined number of them, whereby a group of sheet is collected.

Since four sets of stacking bases 24 and 26 with the driving mechanisms 28, 30 have a similar construction, only one set of them will be described in detail below.

Figure 5:
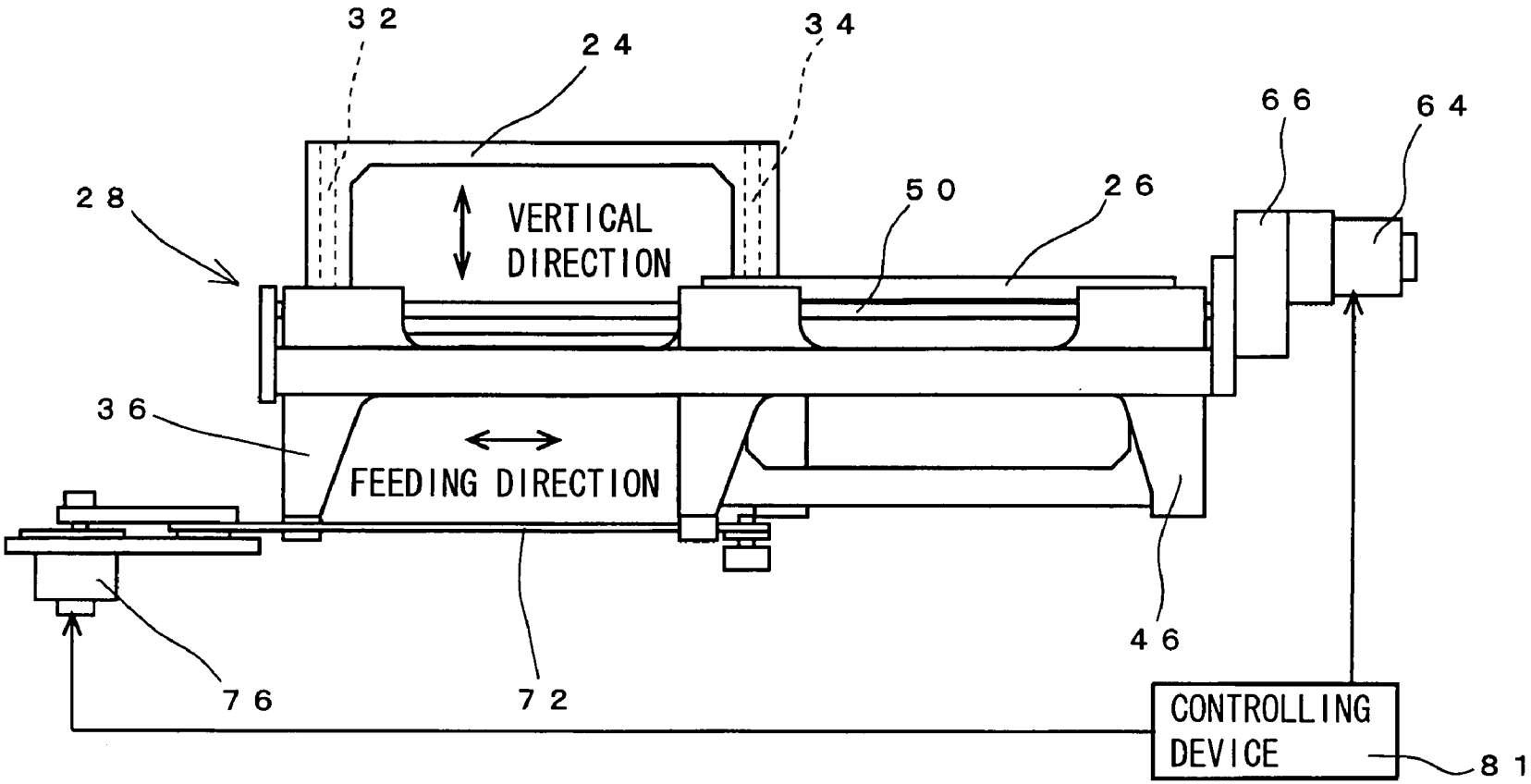
FIG. 5 illustrates a schematic side view of a driving mechanism of an accumulating and delivering apparatus for cardboard sheets in accordance with one embodiment of the present invention.
Figure 7:
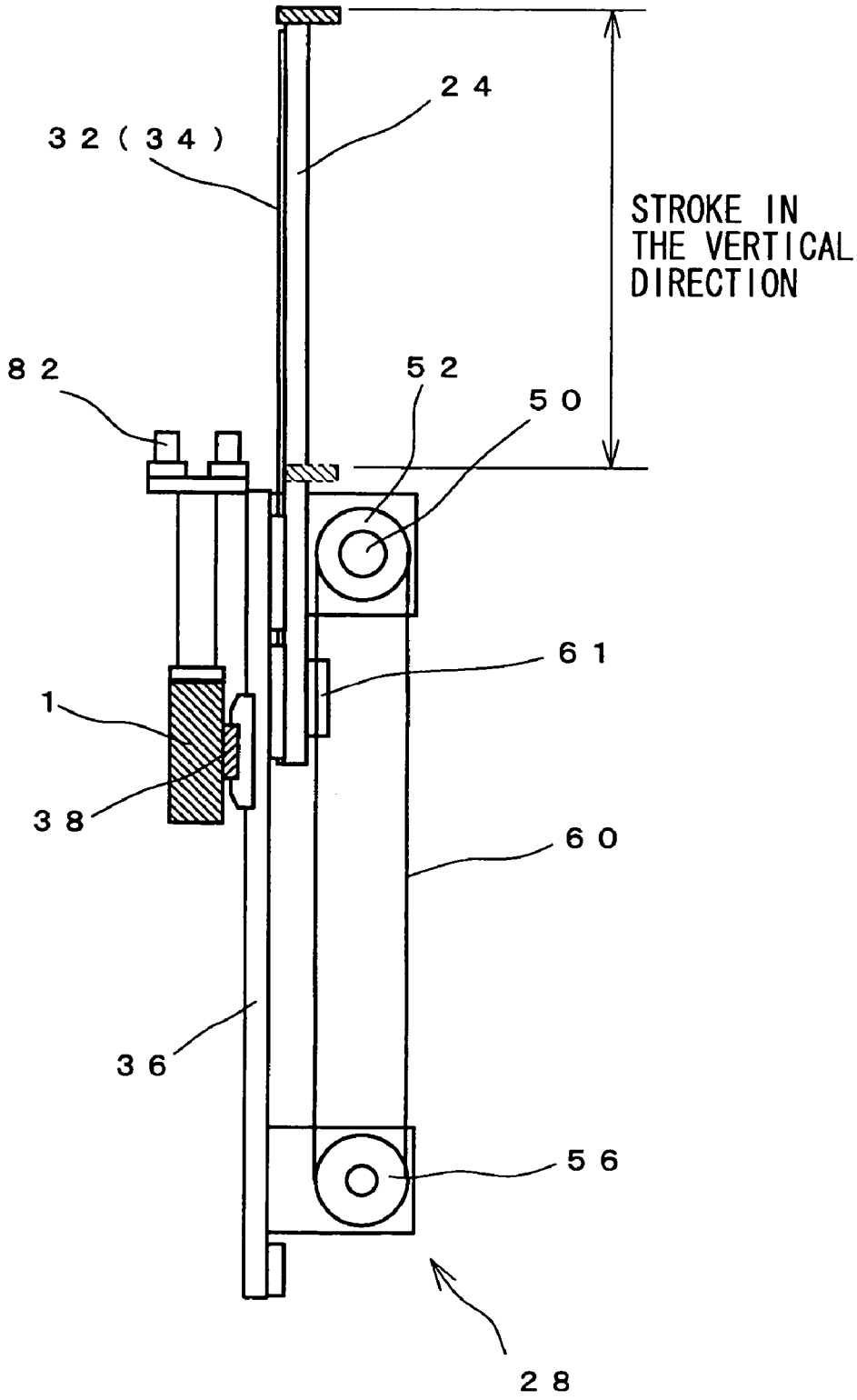
FIG. 7 illustrates an enlarged front view of a driving mechanism which supports one of the stacking bases.
Figure 8:
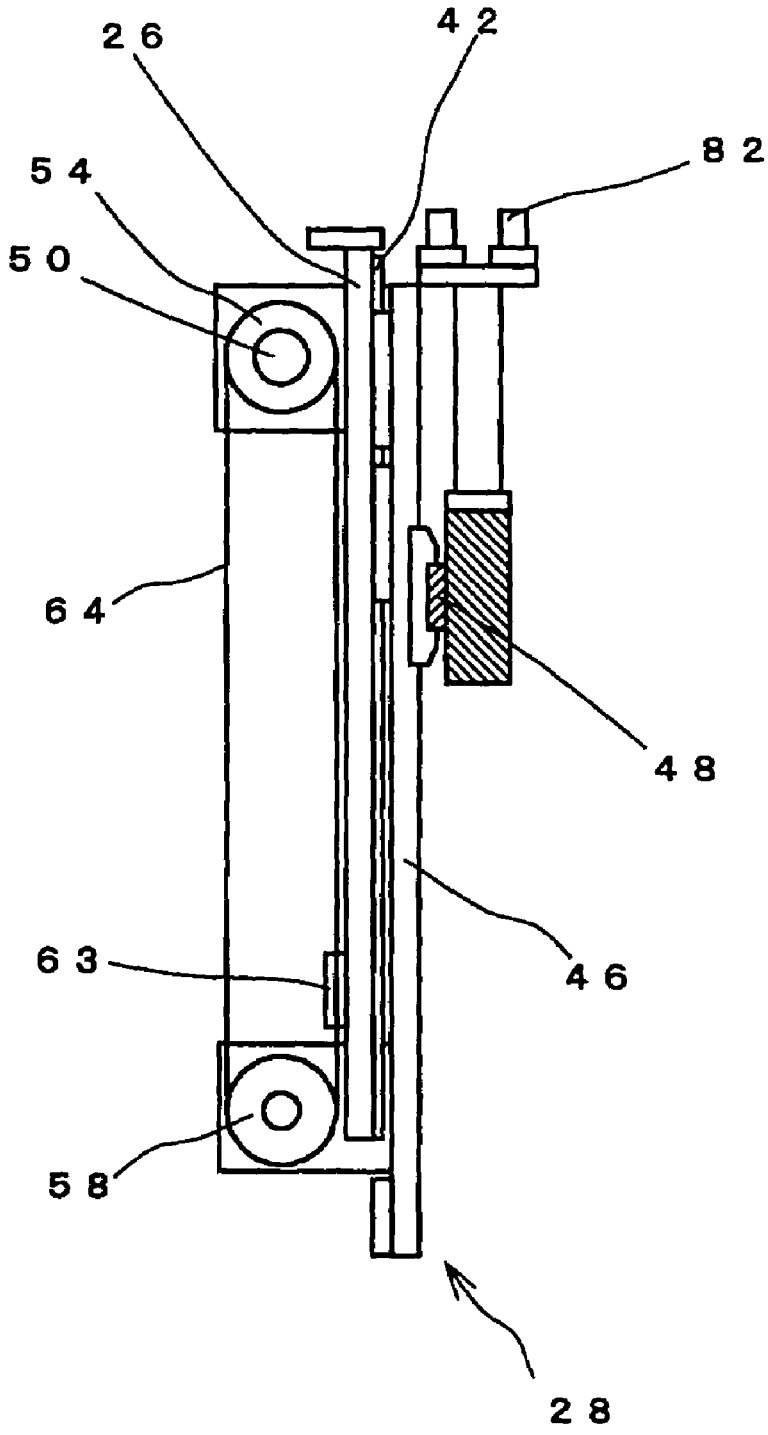
FIG. 8 illustrates an enlarged front view of a driving mechanism which supports the stacking bases.

As can be seen in FIGS. 5 and 7, the stacking base 24 in the stacking bases 24 and 26 is mounted on a moving stage 36 via a pair of rails 32 and 34 which are disposed in a upward/downward moving direction. The moving stage 36 is moveably supported on a rail 38 disposed in a frontward/rearward direction of the machine frame 1. As can be seen in FIG. 8, the stacking base 26 is mounted on a moving stage 46 via a pair of rails 42 (only one is shown) which are disposed in a upward/downward moving direction. The moving stage 46 is moveably supported on a rail 48 disposed in a frontward/rearward direction of the machine frame 1.

A spline shaft 50 is rotationally mounted on the machine frame 1 to be parallel to the rails 38 and 48, as shown in FIG. 5, and a pair of pulleys 52 and 54 are mounted on the spline shaft 50 in such a manner that they can be slidably moveable along the spline shaft 50, whereas they are fixed as to the rotational movement of the spline shaft 50, as shown in FIGS. 7 and 8. One of the pulleys 52 is rotationally mounted on the moving stage 36, while the other one of the pulleys 54 is rotationally mounted on the moving stage 46.

Pulleys 56 and 58 are rotationally mounted below the pair of moving stages 36 and 46, respectively. As can be seen in FIG. 7, a timing belt 60 is wound around the pulley 56 and the pulley 52, both of which are mounted on the moving stage 36. A portion of the timing belt 60 is affixed on the stacking base 24 via a mounting member 61. As can be seen in FIG. 8, a timing belt 64 is wound around the pulley 58 and the pulley 54, both of which are mounted on the moving stage 46. A portion of the timing belt 64 is affixed on the stacking base 26 via a mounting member 63.

As can be seen in FIG. 5, the spline shaft 50 is rotationally driven via a belt transmission device 66 and a servo motor 64 mounted on the machine frame 1. When the spline shaft 50 is rotated in one direction, the stacking base 24 is moved upwardly while the stacking base 26 is moved downwardly. On the contrary, when the spline shaft 50 is rotated in the direction opposite to said one direction, the stacking base 24 is moved downwardly while the stacking base 26 is moved upwardly. In this way, each of the stacking bases 24 and 26 is moved vertically, as shown in FIG. 7, between its first upper level where the stacking bases 24 and 26 can be positioned at a stacking position and an ejecting position, and its second lower level where the stacking bases 24 and 26 can be positioned at a delivering position and a resting position, by the rotation of the spline shaft 50.

Figure 6:
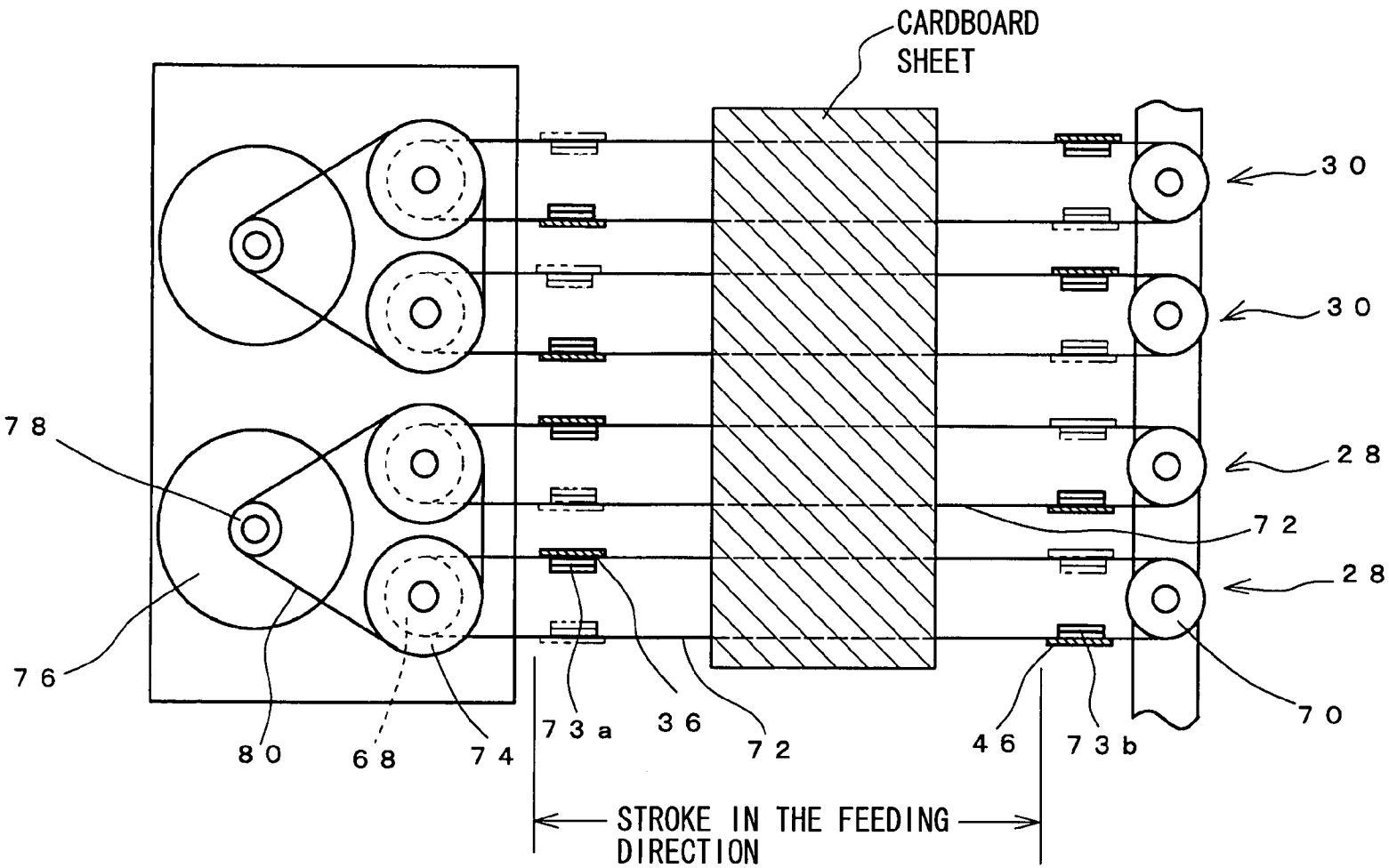
FIG. 6 illustrates a schematic top plan view of four pairs of driving mechanisms which are driven by two servo motors.

As can be seen in FIGS. 5 and 6, a pair of pulleys 68 and 70 are mounted on the machine frame 1 in a spaced apart relationship along the longitudinal direction thereof, and timing belts 72 are wound around each pair of the pulleys 68 and 70, respectively. A pair of the moving stages 36 and 46 are affixed on each one of the timing belts 72 by mounting members 73*a* and 73*b*.

A large pulley 74 is fixedly attached on each of the pulleys 68, and a timing belt 80 is wound around each of the large pulleys 74 and each driving pulley 78 mounted on a servo motor 76 which is mounted on the machine frame 1. When the timing belt 80 is rotationally driven in one direction, the moving stage 36 is moved frontward while the moving stage 46 is moved rearward. On the contrary, when the timing belt 80 is rotationally driven in the direction opposite to said one direction, the moving stage 36 is moved rearward while the moving stage 46 is moved frontward. In this way, the moving stages 36 and 46 are moved by the rotation of the timing belt 80 in frontward or in rearward directions along the feeding direction of the cardboard sheets 6, as shown in FIG. 6, between their first position in the feeding direction and their second position in the feeding direction located rearwardly from the first position with respect to the feeding direction of the cardboard sheets 6.

In this embodiment, two of the driving mechanisms 28 are driven by the commonly used servo motors 64 and 76 in such a manner that two of the spline shafts 50 are driven by only one servo motor 64, while two timing belts 72 are driven by only one servo motor 76. The servo motors 64 and 76 are connected to a controlling device 81, as shown in FIG. 5, and the servo motors 64 and 76 are driven while their rotating speed is being controlled in accordance with the signal supplied from the controlling device 81.

Figure 2:
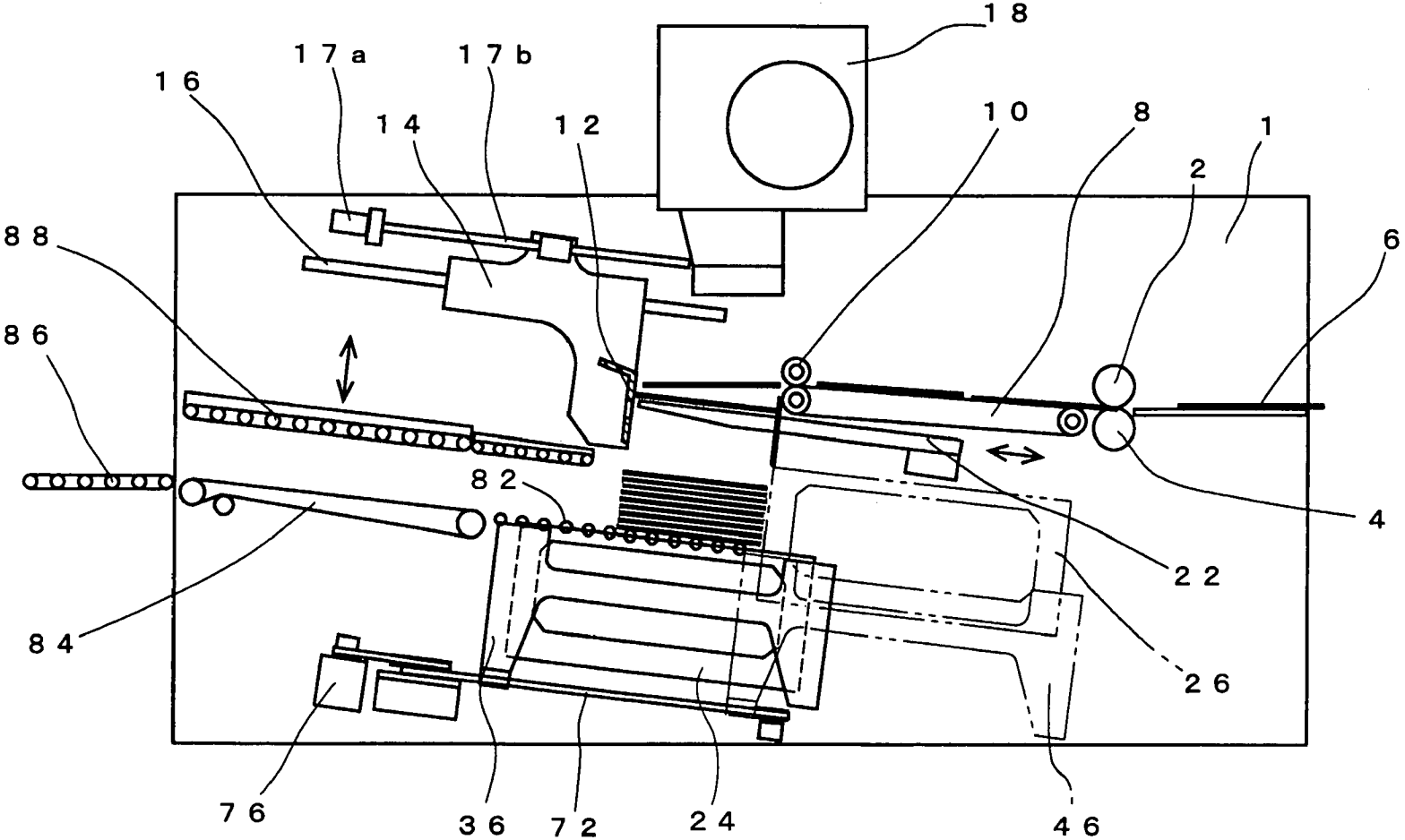
FIG. 2 illustrates a schematic side view of an accumulating and delivering apparatus for cardboard sheets in accordance with one embodiment of the present invention, wherein one of the stacking bases is in its delivering position.
Figure 3:
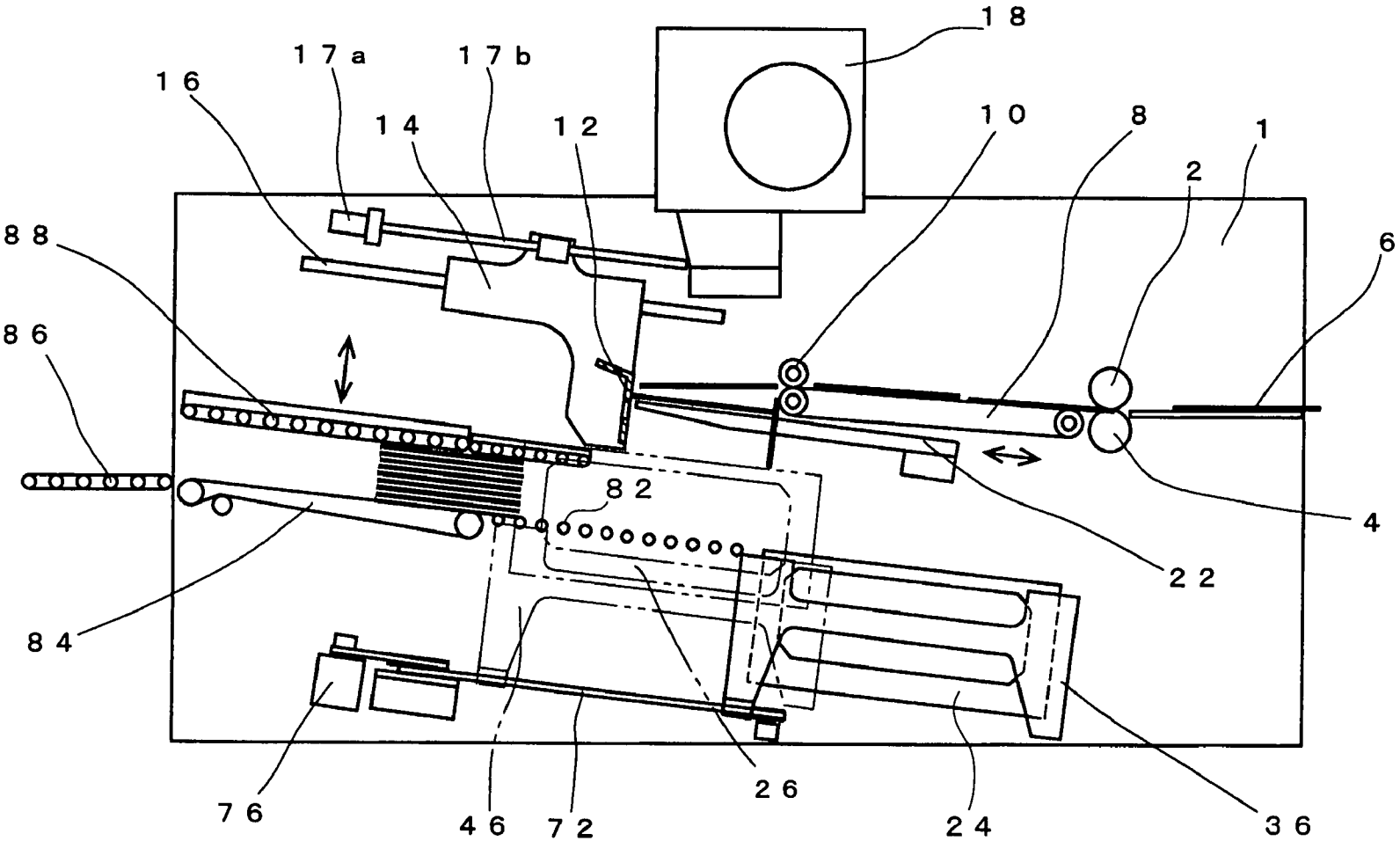
FIG. 3 illustrates a schematic side view of an accumulating and delivering apparatus for cardboard sheets in accordance with one embodiment of the present invention, wherein one of the stacking bases is in its resting position.
Figure 4:
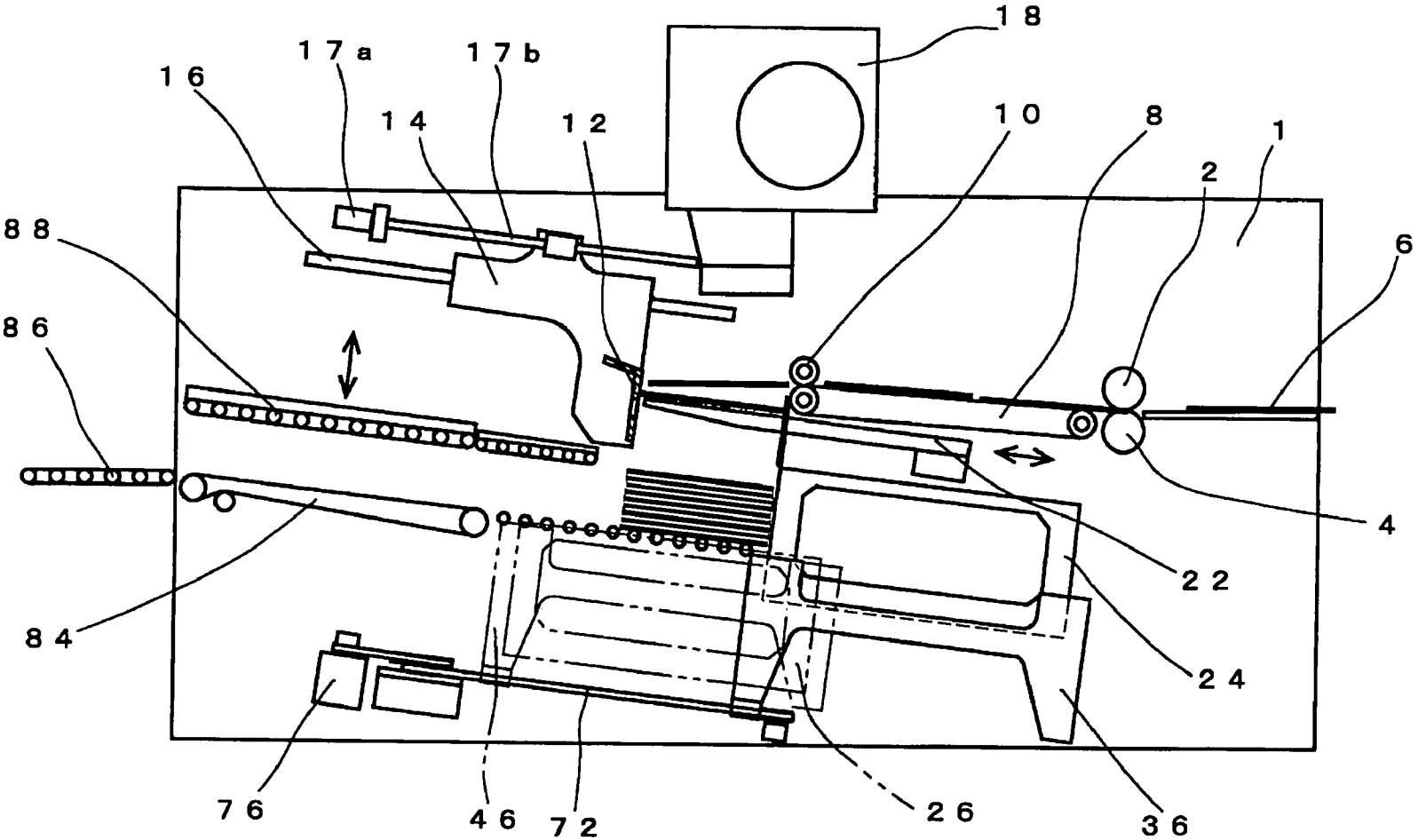
FIG. 4 illustrates a schematic side view of an accumulating and delivering apparatus for cardboard sheets in accordance with one embodiment of the present invention, wherein one of the stacking bases is in its ejecting position.

The driving mechanism 28 enables each of the stacking bases 24 and 26 to move in generally horizontal and vertical directions in a straight manner. Thus, for example, when the stacking base 24 is moved frontward toward its first position in feeding direction as well as upwardly toward its first upper level, it moves toward the stacking position for stacking the cardboard sheets 6 thereon, as shown in FIG. 1. When the stacking base 24 is moved downwardly from this stacking position to its second lower level, it moves toward the delivering position, as shown in FIG. 2, and when the stacking base 24 is moved rearward from the delivering position to its second position in the feeding direction, it moves toward the resting position, as shown in FIG. 3. Furthermore, when the stacking base 24 is moved upwardly from the resting position to its first upper level, it moves toward the ejecting position, as shown in FIG. 4, and when the stacking base 24 is moved frontward from the ejecting position to its first position in the feeding direction, again it moves toward the stacking position, as shown in FIG. 1. In this way, the stacking base 24 can be moved along a rectangular-shaped loop which connects the stacking position, the delivering position, the resting position and the ejecting position, the stacking base 24 being indexed at each of these positions. The stacking base 26 is moved in a same manner, but the movement thereof is 180 degrees different from that of the stacking base 24. In this way, the pair of stacking bases 24 and 26 is moved in such a manner that they are positioned alternately among the four positions, i.e., the stacking position, the delivering position, the resting position and the ejecting position, so that when one of the stacking bases 24 or 26 is positioned in the stacking position, the other one of the stacking bases 26 or 24 is positioned in the resting position, while when one of the stacking bases 24 or 26 is positioned in the delivering position, the other one of the stacking bases 26 or 24 is positioned in the ejecting position.

As can be seen in FIGS. 7 and 8, roller conveyers 82 are disposed along both sides of the driving mechanism 28 in such a manner that the top surface of the roller conveyers 82 is positioned above the top surface of the stacking bases 24 and 26 when they are in the delivering positions, as shown in FIG. 2. An ejecting conveyer 84 and a transport conveyer 86 are disposed along with the roller conveyers 82. A press conveyer 88 is disposed above the ejecting conveyer 84, which press conveyer 88 is adjustable as regards its distance from the ejecting conveyer 84.

The operation of the accumulating and delivering apparatus of the embodiment described above will now be explained below.

When a folded cardboard sheet 6 is fed from a box making machine (not shown) to this apparatus, the cardboard sheet 6 is received by the inlet rollers 2 and 4 therebetween, the cardboard sheet 6 is then carried by the feeding conveyer 8 and the feeding roller 10, and then transferred toward the guiding plate 12. When the front end of the cardboard sheet 6 comes into contact with the guiding plate 12, the cardboard sheet 6 will drop in between the guiding plate 12 and the aligning plate 20 along inner faces of the guiding plate 12 and the aligning plate 20.

At this time, an air flow supplied by the air blower 18 prevents the folded cardboard sheet 6 from being unfolded and pushes the cardboard sheet 6 against the top surface of the stacking bases 24. The position of the guiding plate 12 is adjusted by moving the sliding plate 14 which is driven by the motor 17*a* in such a manner that the distance between the guiding plate 12 and the aligning plate 20 is generally made to correspond to the length of the cardboard sheet 6.

In this way, the cardboard sheet 6 is stacked on the stacking bases 24. As can be seen in FIG. 1, the cardboard sheets 6 being successively fed are stacked on the stacking bases 24 one by one, and the number of the cardboard sheets 6 is detected by a sensor (not shown). When the number of the cardboard sheets 6 reaches a predetermined number, the cardboard sheets 6 form a group stacked on the stacking bases 24, and the ledge 22 is projected through the aligning plate 20, whereby the cardboard sheets 6 are temporarily supported on the ledge 22.

Thereafter, each of the driving mechanisms 28 is activated in order to move the corresponding stacking bases 24 and 26. As can be seen in FIG. 2, the stacking bases 24 supporting the cardboard sheets 6 stacked thereon are moved downwardly from its stacking position to its delivering position. FIGS. 6 and 9 show the group of the cardboard sheets 6 stacked on the stacking bases 24 of four sets of stacking bases 24 and 26. At the same time, the stacking bases 26 are moved upwardly from its resting position to its ejecting position. When the stacking bases 24 are moved downwardly to its delivering position, the pile of cardboard sheets 6 is now supported on the roller conveyer 82. When the stacking bases 24 are moved downwardly to its delivering position, the stacked cardboard sheets 6 is now supported on the roller conveyer 82.

Next, by the activation of each of the driving mechanisms 28, the stacking bases 24 are moved toward the rear from its delivering position to its resting position, as shown in FIG.

3. At the same time, the stacking bases 26 are moved toward the front from its ejecting position to its stacking position. With this movement of the stacking bases 26, the stacked cardboard sheets 6 being supported on the roller conveyer 82 is pushed out by the front ends of the stacking bases 26 forwardly with respect to the feeding direction, and transferred on the ejecting conveyer 84. The stack of cardboard sheets 6 is held between the ejecting conveyer 84 and the press conveyer 88 and carried onto the transport conveyer 86, and then carried out of the apparatus thereby.

The stacking bases 26, which are now moved to its stacking position, receives the cardboard sheets 6 temporarily supported on the ledge 22, the ledge 22 being retracted after the stacking bases 26 are moved in its stacking position. Similar to the operation of the stacking bases 24 described above, the cardboard sheets 6 being successively fed are now stacked on the stacking bases 26 one by one, and when the number of the cardboard sheets 6 reaches a predetermined number, the ledge 22 is again projected through the aligning plate 20, whereby the cardboard sheets 6 are temporarily supported on the ledge 22. Although it is preferable to start retracting the ledge 22 after the stacking bases 26 have completely moved to its stacking position, retracting of the ledge 22 may be started while the stacking bases 26 are still moving toward its stacking position.

Thereafter, the stacking bases 26 are moved from its stacking position to its delivering position, as shown in FIG. 4, whereby the cardboard sheets 6 stacked thereon is supported on the roller conveyer 82. At the same time, the stacking bases 24 are moved upwardly from its resting position to its ejecting position. Next, the stacking bases 26 are moved toward the rear from its delivering position to its resting position, while the one of the stacking bases 24 is moved frontward from its ejecting position to its stacking position, so that the cardboard sheets 6 being supported on the roller conveyer 82 are pushed out by the front ends of the stacking bases 24, and transferred on the ejecting conveyer 84. By repeating these operation cycles, the cardboard sheets 6 can be delivered out from this apparatus in the form of an unit consisting of a predetermined number of the cardboard sheets 6.

In an alternative embodiment of the present invention, the ledge 22 can be eliminated under some conditions, including the feeding speed of the cardboard sheet, the receiving depth formed between the guiding plate 12 and the aligning plate 20, or the moving speeds of the stacking bases 24 and 26.

The embodiment shown in the drawings and described above is only one way to realize the subject matter of this invention. Those skilled in the art will be able to realize the invention in different embodiments without departing from the spirit and scope of the invention.

What is claimed is:

1. An accumulating and delivering apparatus for feeding cardboard sheets one by one, each cardboard sheet having a lower surface, comprising:

a plurality of stacking bases for stacking said cardboard sheets thereon;

a stacking base driving means for moving said stacking bases in a vertical direction between a stacking position for stacking said cardboard sheets on said stacking bases in a form of a group and a delivering position for delivering said group of said cardboard sheets formed on said stacking base;

a ledge for supporting the lower surfaces of said cardboard sheets being fed when said stacking base is moved out from its stacking position, said ledge being a single ledge always maintained at a desired level located between a level corresponding to said stacking position and a level corresponding to said delivering position, wherein said stacking bases comprise at least one pair of stacking bases, each of said pair of stacking bases being moveable between said stacking position and said delivering position via a path including an ejecting position located rearwardly from said stacking position with respect to the feeding direction of said cardboard sheets, wherein when one of said stacking bases is moved from said ejecting position to said stacking position, said one of said stacking bases moving to said stacking position ejects said group of said cardboard sheets previously formed on another one of said stacking bases by pushing it out forwardly in a direction with respect to the feeding direction of said cardboard sheets, and wherein said stacking base driving means moves said stacking bases in such a manner that when one of said stacking bases is moved away from said stacking position, another of said stacking bases is moved into said stacking position and that said stacking bases are kept offset to each other in the sheet feeding direction.

2. The accumulating and delivering apparatus for cardboard sheets as recited in claim 1, each of said pair of stacking bases being moveable via a path including said delivering position located below said stacking position and a resting position located rearwardly from said delivering position with respect to the feeding direction of said cardboard sheets, said stacking bases being moveable in accordance with the order of said stacking position, said delivering position, said resting position and said ejecting position, respectively, and said stacking bases being indexed at these respective positions, wherein one of said stacking bases and another one of said stacking bases are positioned in such a manner that they have positions alternated among said four positions.

3. The accumulating and delivering apparatus for cardboard sheets as recited in claim 2, said stacking base driving means including a stacking base vertical driving means for moving said one of the stacking bases downwardly from said stacking position to said delivering position while moving said other one of the stacking bases upwardly from said resting position to said ejecting position, and;

a stacking base horizontal driving means for moving said one of the stacking bases from said delivering position to said resting position rearwardly with respect to the feeding direction of said cardboard sheets while moving said other one of the stacking bases from said ejecting position to said stacking position forwardly with respect to the feeding direction of said cardboard sheets.

4. The accumulating and delivering apparatus for cardboard sheets as recited in any one of claims 1 to 3, further comprising a stacking base controlling means for controlling the moving speed of said pair of said stacking bases.

* * * * *